US011414301B2

(12) United States Patent
Antin

(10) Patent No.: US 11,414,301 B2
(45) Date of Patent: Aug. 16, 2022

(54) METHOD AND ARRANGEMENT FOR CONDITION MONITORING OF A HOISTING ROPE OF A HOISTING APPARATUS

(71) Applicant: KONE Corporation, Helsinki (FI)

(72) Inventor: Kim Antin, Helsinki (FI)

(73) Assignee: KONE CORPORATION, Helsinki (FI)

( * ) Notice: Subject to any disclaimer, the term of this patent is extended or adjusted under 35 U.S.C. 154(b) by 705 days.

(21) Appl. No.: 16/398,846

(22) Filed: Apr. 30, 2019

(65) Prior Publication Data

US 2019/0256324 A1 Aug. 22, 2019

Related U.S. Application Data

(63) Continuation of application No. PCT/EP2017/082835, filed on Dec. 14, 2017.

(30) Foreign Application Priority Data

Dec. 16, 2016 (EP) ..... 16204611

(51) Int. Cl.
*B66B 7/12* (2006.01)

(52) U.S. Cl.
CPC ..... *B66B 7/1223* (2013.01)

(58) Field of Classification Search
CPC ..... B66B 7/123; B66B 5/0018; B66B 7/1223; B66B 7/1261

(Continued)

(56) References Cited

U.S. PATENT DOCUMENTS 5,834,942 A * 11/1998 De Angelis ..... D07B 1/148 73/158
6,886,666 B2 * 5/2005 Stucky ..... B66B 7/123 73/158

(Continued)

FOREIGN PATENT DOCUMENTS

EP 3 269 674 A1 1/2018
WO WO 2018/037013 A1 3/2018

OTHER PUBLICATIONS

Burda et al., "Soldering of Carbon Materials Using Transition Metal Rich Alloys", ACS NANO, vol. 9, No. 8, 2015, pp. 8099-8107.

(Continued)

*Primary Examiner* — Jeffrey Donels
(74) *Attorney, Agent, or Firm* — Birch, Stewart, Kolasch & Birch, LLP

(57) ABSTRACT

A method for condition monitoring of a hoisting rope of a hoisting apparatus and an arrangement for condition monitoring of a hoisting rope of a hoisting apparatus, preferably of an elevator for transporting passengers and/or goods are disclosed. The arrangement for condition monitoring of a hoisting rope of a hoisting apparatus, the hoisting rope includes a non-conductive coating, and a plurality of adjacent conductive load bearing members for bearing the load exerted on the hoisting rope in longitudinal direction thereof embedded in the coating and extending parallel to each other and to the longitudinal direction of the hoisting rope, the coating forming the surface of the hoisting rope and extending between adjacent load bearing members thereby isolating them from each other, and a control system, the control system including an analyzer unit for generating and inserting propagating electromagnetic wave signals to an at least one parallel conductor transmission line formed by the conductive load bearing members and for detecting and analyzing reflected electromagnetic wave signals from the (Continued)

an at least one parallel conductor transmission line formed by the conductive load bearing members.

20 Claims, 12 Drawing Sheets

(58) Field of Classification Search
USPC ..... 187/393
See application file for complete search history.

(56) References Cited

U.S. PATENT DOCUMENTS

| | | | | |
|---|---|---|---|---|
| 9,335,318 | B2 * | 5/2016 | Ilaka | B66C 15/00 |
| 9,796,561 | B2 * | 10/2017 | Guilani | B66B 5/02 |
| 9,828,216 | B2 * | 11/2017 | Berben | B66B 7/1223 |
| 10,214,396 | B2 * | 2/2019 | Mupende | B66D 1/54 |
| 2003/0011483 | A1 * | 1/2003 | Lamb | B66B 7/1223 187/390 |
| 2011/0266097 | A1 | 11/2011 | Valjus et al. | |
| 2013/0119256 | A1 * | 5/2013 | Husmann | D07B 1/145 250/341.1 |
| 2013/0126737 | A1 * | 5/2013 | Husmann | B66B 7/1238 250/341.1 |
| 2013/0153340 | A1 | 6/2013 | Dold | |
| 2014/0182974 | A1 * | 7/2014 | Puranen | B66B 7/1223 187/247 |
| 2015/0291394 | A1 | 10/2015 | Dold et al. | |
| 2016/0002006 | A1 | 1/2016 | Sun et al. | |
| 2016/0229667 | A1 * | 8/2016 | Cereghetti | B66B 7/1223 |
| 2018/0306752 | A1 * | 10/2018 | Puranen | B66B 7/1215 |
| 2019/0202666 | A1 * | 7/2019 | Juntunen | G01N 27/902 |
| 2019/0219530 | A1 * | 7/2019 | Antin | B66B 7/1215 |

OTHER PUBLICATIONS

International Search Report (PCT/ISA/210) issued in PCT/EP2017/082835, dated Jul. 16, 2018.

Search Opinion issued in European Patent Application No. 16204611.4, dated Sep. 12, 2017.

Written Opinion (PCT/ISA/237) issued in PCT/EP2017/082835, dated Jul. 16, 2018.

* cited by examiner

METHOD AND ARRANGEMENT FOR CONDITION MONITORING OF A HOISTING ROPE OF A HOISTING APPARATUS

CROSS REFERENCE TO RELATED APPLICATIONS

This application is a Continuation of PCT International Application No. PCT/EP2017/082835, filed on Dec. 14, 2017, which claims priority under 35 U.S.C. 119(a) to patent application Ser. No. 16/204,611.4, filed in Europe on Dec. 16, 2016, all of which are hereby expressly incorporated by reference into the present application.

FIELD OF THE INVENTION

The invention relates to a method for condition monitoring of a hoisting rope of a hoisting apparatus, and to an arrangement for condition monitoring of a hoisting rope of a hoisting apparatus. Said hoisting apparatus is preferably an elevator for transporting passengers and/or goods.

BACKGROUND OF THE INVENTION

Hoisting ropes typically include one or several load bearing members that are elongated in the longitudinal direction of the rope, each load bearing member forming a structure that continues unbroken throughout the length of the rope. Load bearing members are the members of the rope which are able to bear together the load exerted on the rope in its longitudinal direction. The load, such as a weight suspended by the rope, causes tension on the load bearing member in the longitudinal direction of the rope, which tension can be transmitted by the load bearing member in question all the way from one end of the rope to the other end of the rope. Ropes may further comprise non-bearing components, such as an elastic coating, which cannot transmit tension in the above described way.

In prior art, such hoisting ropes exist where the load bearing members are embedded in non-conducting coating, such as polymer coating, forming the surface of the hoisting rope and extending between adjacent load bearing members thereby isolating them from each other both mechanically and electrically.

For facilitating awareness of condition of the ropes, and thereby for improving safety of the hoisting apparatus, monitoring of the condition of the load bearing members has been proposed. The visual inspection of the internal tensile elements is generally not possible and hence the need arises for non-visual inspection. The condition monitoring has been proposed in prior art to be arranged by monitoring electrical parameters of the load bearing members.

One known method for checking the condition of the tensile elements is the resistance-based inspection, which is based on a measure of the electrical resistance of the tensile elements. A change in the electrical resistance or a deviation from an expected value is interpreted as a damage of the tensile elements. There are some drawbacks to this method. It has been found, however, that non negligible damages may nevertheless result in small variations of the electrical resistance of common tensile elements such as steel cords. Consequently, the sensitivity of the resistance-based inspection is not satisfactory.

A prior art US Patent Application document US 2016/0229667 A1 discloses a prior art solution for checking the integrity of load bearing members of an elevator system said load bearing members comprising tensile elements, in which the condition of a tensile element is determined by sending a pulse through the tensile element and analysing the feedback pulse which is received from the tensile element.

One prior art method for condition monitoring of a hoisting rope is to place an electrically conductive member within the rope. The status of the conductive member may be tested by applying an electrical current to the member. If damage occurs to an extent great enough to break the conductive member, the electrical circuit is broken. There are some drawbacks to this method. In this method there is no qualitative information to indicate if the rope is degrading during use as the first indication is provided by the broken conductive member. Furthermore, the method provides no information on the location of the damage along the length of the rope.

BRIEF DESCRIPTION OF THE INVENTION

The object of the invention is to introduce a method for condition monitoring of a hoisting rope of a hoisting apparatus, as well as an arrangement for condition monitoring of a hoisting rope of a hoisting apparatus, wherein information is provided on the location of the damage along the length of the hoisting rope of a hoisting apparatus. Advantageous embodiments are furthermore presented, inter alia, wherein qualitative information about the damage magnitude is provided.

It is brought forward a new method for condition monitoring of a hoisting rope of a hoisting apparatus, which hoisting rope comprises a non-conductive coating, and a plurality of adjacent conductive load bearing members for bearing the load exerted on the hoisting rope in longitudinal direction thereof embedded in the coating and extending parallel to each other and to the longitudinal direction of the hoisting rope, the coating forming the surface of the hoisting rope and extending between adjacent load bearing members thereby isolating them from each other, in which method a propagating electromagnetic wave signal is generated and inserted to an at least one parallel conductor transmission line formed by said conductive load bearing members, a reflected electromagnetic wave signal from said an at least one parallel conductor transmission line formed by said conductive load bearing members is detected, said detected electromagnetic wave signal is analyzed. Hereby, one or more of the above mentioned advantages and/or objectives are achieved. These advantages and/or objectives are further facilitated with the additional preferred features and/or steps described in the following.

In a preferred embodiment of said method, said conductive load bearing members are made of non-metal material.

In a preferred embodiment of said method, said conductive load bearing members are made of composite material comprising electrically conducting reinforcing fibers in polymer matrix, said reinforcing fibers preferably being carbon fibers.

In a preferred embodiment, one or more parameters for determining the condition of the hoisting rope is provided.

In a preferred embodiment, information about the location of damage and/or about the magnitude of impedance mismatch is provided.

In a preferred embodiment, information for quantifying the severity of the defect such as e.g. fiber damage is provided.

In a preferred embodiment, after receiving said one or more parameters for the determination of the condition of the hoisting rope condition monitoring actions are performed.

In a preferred embodiment, said method further comprises the following steps for improving an electrical contact between an analyzer unit and the conductive load bearing members: cutting the end of the hoisting rope, removing non-conductive materials around carbon fibers, coating exposed fibers with metal, e.g. with copper or nickel, and soldering connections interfaces of an analyzer unit to the coated exposed fibers of the hoisting rope end.

In a preferred embodiment, said method further comprises the following steps for improving an electrical contact between an analyzer unit and the conductive load bearing members: cutting the end of the hoisting rope, removing non-conductive materials around carbon fibers, and clamping connection interfaces of an analyzer unit to the exposed fibers of the hoisting rope end.

In a preferred embodiment, said method further comprises the following steps for improving an electrical contact between an analyzer unit and the conductive load bearing members: cutting the end of the hoisting rope, removing non-conductive materials around carbon fibers, coating exposed fibers with metal, e.g. with copper or nickel, clamping connection interfaces of an analyzer unit to the coated exposed fibers of the hoisting rope end.

It is also brought forward a new arrangement for condition monitoring of a hoisting rope of a hoisting apparatus, which hoisting rope comprises a non-conductive coating, and a plurality of adjacent conductive load bearing members for bearing the load exerted on the hoisting rope in longitudinal direction thereof embedded in the coating and extending parallel to each other and to the longitudinal direction of the hoisting rope, the coating forming the surface of the hoisting rope and extending between adjacent load bearing members thereby isolating them from each other, which arrangement comprises a control system, said control system comprising an analyzer unit for generating and inserting propagating electromagnetic wave signals to an at least one parallel conductor transmission line formed by said conductive load bearing members and for detecting and analyzing reflected electromagnetic wave signals from said an at least one parallel conductor transmission line formed by said conductive load bearing members.

In a preferred embodiment of said arrangement, said conductive load bearing members are made of non-metal material.

In a preferred embodiment of said arrangement, said conductive load bearing members are made of composite material comprising electrically conducting reinforcing fiber in polymer matrix, said reinforcing fibers preferably being carbon fibers.

In a preferred embodiment, said analyzer unit provides one or more parameters for determining the condition of the hoisting rope.

In a preferred embodiment, said analyzer unit according to the present invention is a signal generator/analyzer unit, a network analyzer unit, a scalar network analyzer unit or a vector network analyzer unit.

In a preferred embodiment, said control system comprises a condition monitoring unit for monitoring one or more parameters provided by the analyzer unit so as to determine condition of the hoisting rope.

In a preferred embodiment, said arrangement comprises connections interfaces for coupling the analyzer unit to the conductive load bearing members at the first end of the hoisting rope.

In a preferred embodiment, said arrangement comprises one or more additional conductors extending unbroken throughout the length of the hoisting rope.

In a preferred embodiment, said one or more additional conductors are of the same material as the conductive load bearing members.

In a preferred embodiment, said arrangement comprises additional connections interfaces for coupling the analyzer unit to the conductive load bearing members at the other end of the hoisting rope.

In a preferred embodiment, said arrangement comprises an at least one impedance matching element arranged at the other end of the hoisting rope connected between the ends of said load bearing members for matching the impedance of said an at least one parallel conductor transmission line.

In a preferred embodiment, upon detecting of a reflected electromagnetic wave signal having stable amplitude except for the repeated peaks the analyzer unit provides one or more parameters for the determination that the condition of the hoisting rope is faultless.

In a preferred embodiment, upon detecting of a reflected electromagnetic wave signal having a defect indicating peaks the analyzer unit provides one or more parameters for the determination that the condition of the hoisting rope is has a fault and for the determination of the types of the defects and condition of the hoisting rope.

In a preferred embodiment, said analyzer unit provides information about the location of damage and/or about the magnitude of impedance mismatch.

In a preferred embodiment, said analyzer unit provides information for quantifying the severity of the defect such as e.g. fiber damage.

In a preferred embodiment, said hoisting rope is belt-shaped, i.e. larger in width direction than thickness direction.

In a preferred embodiment, said upon receiving said one or more parameters for the determination of the condition of the hoisting rope, said monitoring unit performs condition monitoring actions.

In a preferred embodiment, said analyzer carries out multiple measurements by changing signal form, signal amplitude and/or signal frequency.

In a preferred embodiment, said analyzer carries out measurements for counter-acting distortion and attenuation effects.

In a preferred embodiment, said analyzer carries out measurements for matching the impedance of the parallel conductor transmission lines.

BRIEF DESCRIPTION OF THE DRAWINGS

In the following, the present invention will be described in more detail by way of example and with reference to the attached drawings, in which.

DETAILED DESCRIPTION

Figure 1:
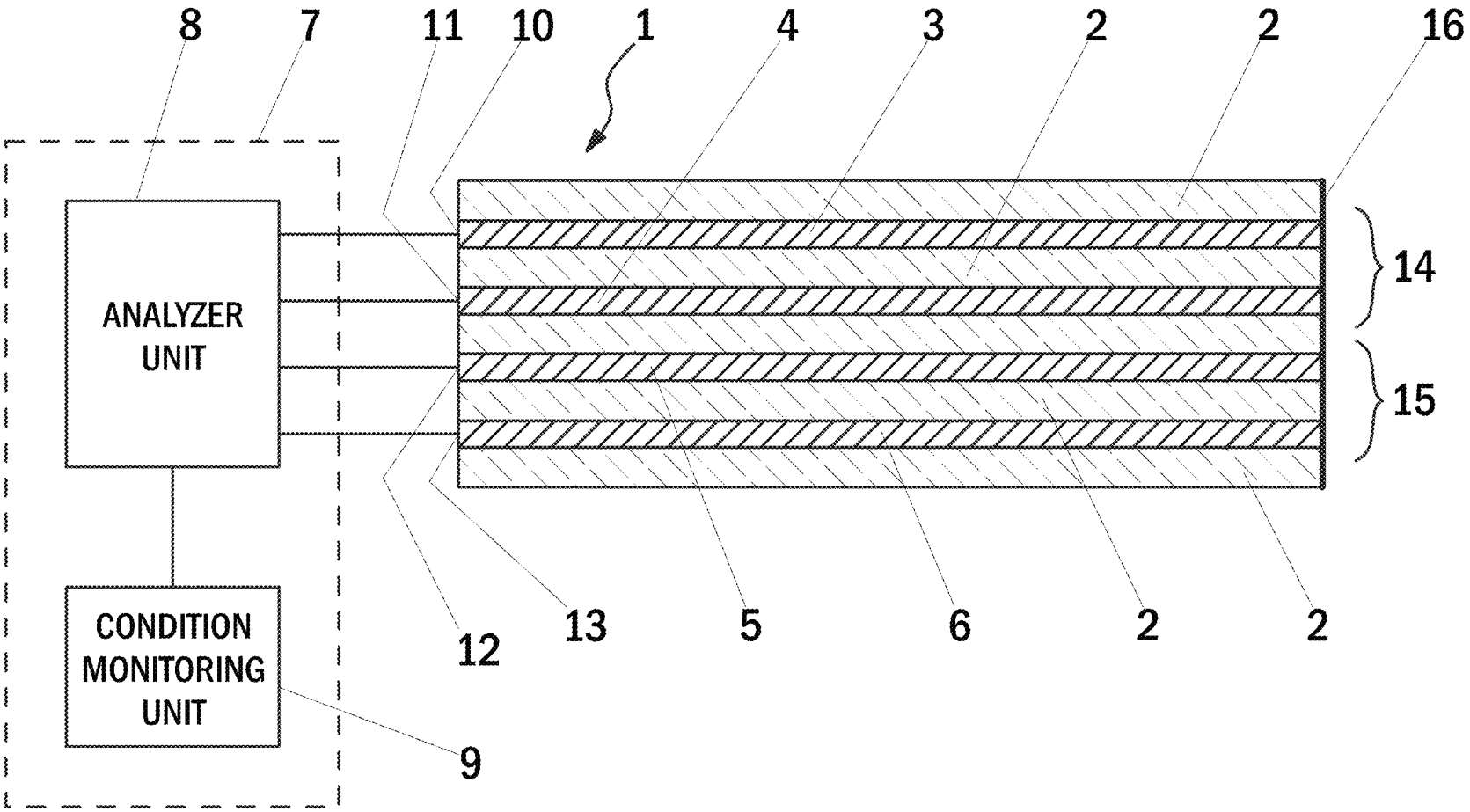
FIG. 1 illustrates an arrangement for condition monitoring of a hoisting rope of a hoisting apparatus according to one embodiment of the present invention.

FIG. 1 illustrates an arrangement for condition monitoring of a hoisting rope of a hoisting apparatus according to one embodiment of the present invention. The hoisting rope 1 is belt-shaped, i.e. larger in width direction than thickness direction and has a first end and other end 16. The hoisting rope 1 comprises a non-conductive coating 2, and a plurality of conductive load bearing members 3-6 for bearing the load exerted on the hoisting rope 1 in longitudinal direction thereof, which are adjacent in width direction of the hoisting rope 1. The load bearing members 3-6 are embedded in the non-conductive coating 2 and extend parallel to each other as well as to the longitudinal direction of the hoisting rope 1 unbroken throughout the length of the hoisting rope 1. The coating 2 forms the surface of the hoisting rope 1 and extends between adjacent load bearing members 3-6, thereby isolating them from each other both mechanically and electrically. The said conductive load bearing members 3-6 may be made of non-metal material. The said conductive load bearing members 3-6 may be made of composite material comprising electrically conducting reinforcing fibers in polymer matrix, said reinforcing fibers preferably being carbon fibers.

The arrangement for condition monitoring of a hoisting rope of a hoisting apparatus according to the embodiment of the present invention presented in FIG. 1 also comprises a control system 7 for controlling the hoisting apparatus. The control system 7 according to the presented arrangement also comprises an analyzer unit 8 capable of generating and inserting propagating electromagnetic wave signals to said conductive load bearing members 3-6 and capable of detecting and analyzing reflected electromagnetic wave signals from said conductive load bearing members 3-6. The analyzer unit 8 according to the present invention may be a signal generator/analyzer unit 8 or a network analyzer unit 8, such as e.g. a scalar network analyzer unit 8 or a vector network analyzer unit 8. In an alternative embodiment, the measurements can also be made in time-domain directly using a signal generator, a power splitter, a directional coupler and an oscilloscope. In the alternative embodiment the generated signal is split between the oscilloscope for reference and the rope under testing; the directional coupler is used for sensing only the reflected backwards travelling wave and feeding it to the oscilloscope for analysis. The control system 7 according to the presented arrangement may also comprise a condition monitoring unit 9 for monitoring one or more parameters provided by the analyzer unit 8 so as to determine condition of the hoisting rope 1.

The presented arrangement has connections interfaces 10-13 for coupling the analyzer unit 8 to the conductive load bearing members 3-6 at the other end 16 of the hoisting rope 1. In the arrangement for condition monitoring of a hoisting rope of a hoisting apparatus according to the presented embodiment of the present invention there is created a first parallel conductor transmission line 14 using two individual conductive load bearing members 3, 4. Respectively, a second parallel conductor transmission line 15 is created using two individual conductive load bearing members 5, 6. Consequently, two transmission lines 14, 15 next to each other in the same hoisting rope 1 are created.

In an alternative embodiment of the present invention, each transmission line comprises of one conductive load bearing members 3-6 of a plurality of conductive load bearing members 3-6 and an at least one additional metallic or non-metallic conductor either embedded in the dielectric protective coating or outside it in free air separated using standoffs. An additional conductor of the same material as the load bearing conductor (preferably carbon fiber), may be beneficial to make thermal effects symmetric, such as thermal expansion or temperature dependency of electrical properties. The said transmission line could be coaxial with a conductive shield around the carbon fiber element. This would reduce interference from outside sources. The said transmission line could be a microstrip line, with a plate of conductive material, e.g. copper running in parallel with the carbon fiber element. This way individual carbon fiber elements can be inspected one by one without relying on a possibly broken adjacent carbon fiber element. The said transmission line could be a stripline, with two ground plates on either side of the carbon fiber element for better isolation compared to the microstrip line. The said transmission line could also be a cage line with multiple parallel conductors surrounding the center conductor, but not being in contact with each other like the shielding of a coaxial line. Furthermore, the transmission line can experience losses due to dispersion caused by frequency-dependent phase velocity. The said transmission line could also be a loaded transmission line so as to increase inductance and to meet the Heaviside condition of a distortion-free line. The said loading can be continuous or patched, e.g. by having the conductor wrapped with a material with high magnetic permeability.

In the arrangement for condition monitoring of a hoisting rope of a hoisting apparatus according to the embodiment of the present invention a propagating electromagnetic wave signal, e.g. an alternating voltage/current signal is generated and inserted by the analyzer unit 8 which said alternating voltage/current signals are inserted to said conductive load bearing members 3-6 for propagating in positive z-direction according well-established one-directional wave equations.

As the electromagnetic wave signal, e.g. the alternating voltage/current signal propagating along the first parallel conductor transmission line 14 or along the second parallel conductor transmission line 15 reaches the other end 16 of the hoisting rope 1 a portion of the said signal will reflect back as a reflected electromagnetic wave signal.

The reflected electromagnetic wave signal reflecting from the other end 16 of the hoisting rope 1 propagates back along the first parallel conductor transmission line 14 or along the second parallel conductor transmission line 15 and is detected and analyzed by the analyzer unit 8. After the analysis the analyzer unit 8 provides one or more parameters for monitoring by the condition monitoring unit 9. After the condition monitoring unit 9 has received one or more parameters for the determination of the types of the defects and condition of the hoisting rope 1 the condition monitoring unit 9 performs condition monitoring actions.

In another alternative embodiment of the present invention, there are additional connection interfaces coupled to the conductive load bearing members 3-6 at the other end 16 of the hoisting rope 1 also to the analyzer unit 8. The benefit of making a connection at both ends is that the signal direction can be reversed and the observed signal should look the same if no faults are present. This can be used to measure a transmission coefficient and to find systematic errors in the setup. Having both the first end and the other end 16 connected to the analyzer unit 8, e.g. a network analyzer 8 is beneficial also if the fault is located close to either end because the travelled distance of the wave is minimized and hence the power transfer losses also.

Figure 2:
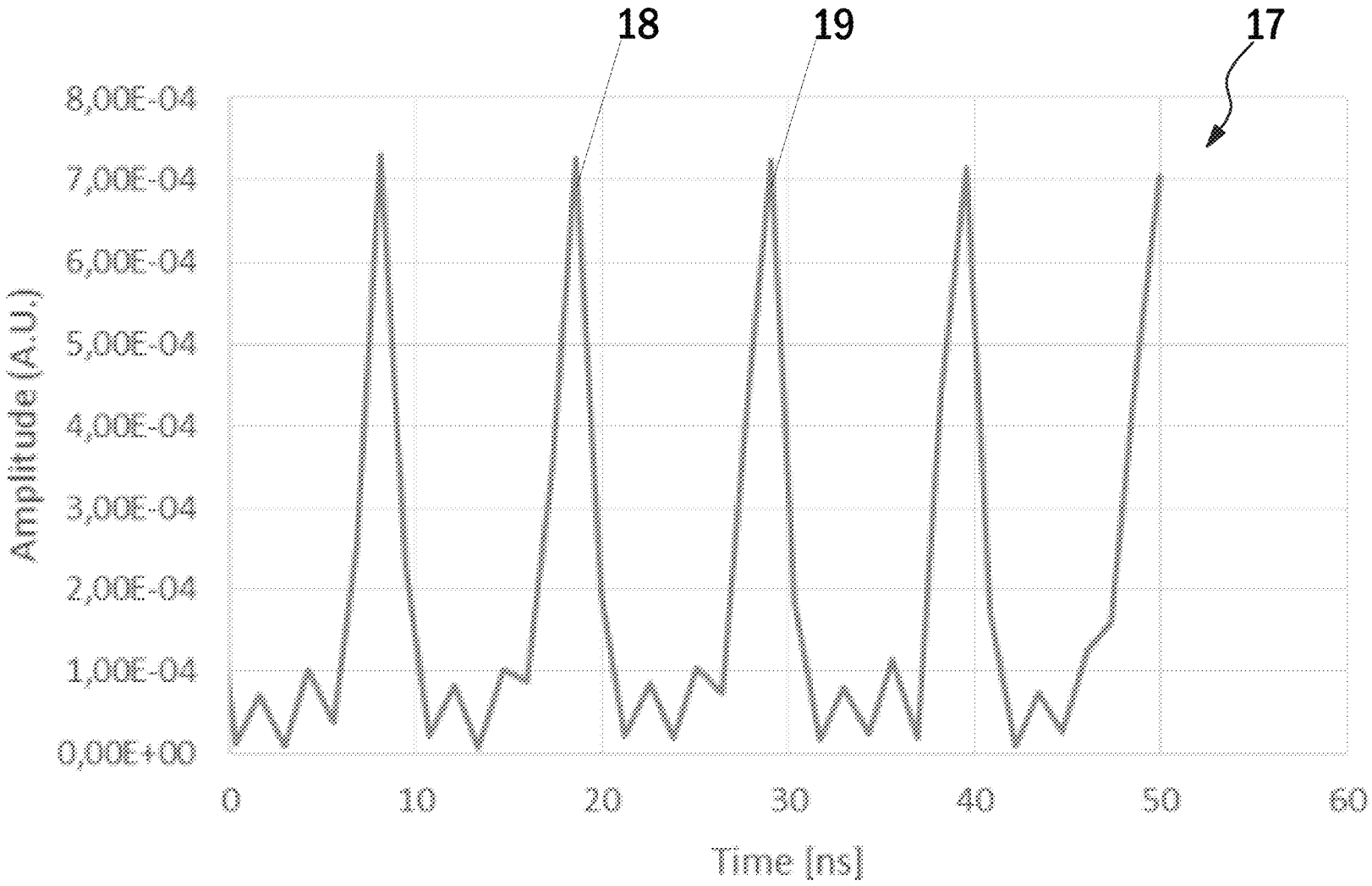
FIG. 2 illustrates one example of a reflected electromagnetic wave signal according to one embodiment of the present invention.

FIG. 2 illustrates one example of a reflected electromagnetic wave signal according to one embodiment of the present invention. In the example shown in FIG. 2 a reflected electromagnetic wave signal 17 is reflected back from the other end 16 of the hoisting rope 1. In the reflected electromagnetic wave signal 17 according to the presented embodiment there can be detected repeated peaks 18, 19 reflected back from the other end 16 of the hoisting rope 1. As the amplitude of the detected reflected electromagnetic wave signal 17 is stable except for the repeated peaks 18, 19 reflected back from the other end 16 of the hoisting rope 1 the analyzer unit 8 may provide one or more parameters to the condition monitoring unit 9 for the determination that the condition of the hoisting rope 1 is faultless.

Figure 3:
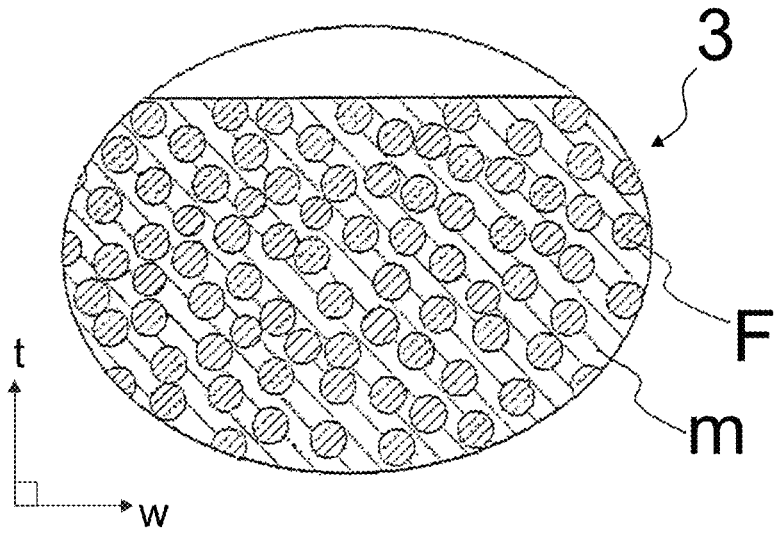
FIG. 3 illustrates a preferred inner structure of the load bearing member according to the present invention.

FIG. 3 illustrates a preferred inner structure of the load bearing member according to the present invention. In FIG. 3 the width direction w and the thickness direction t of a load bearing member 3 is shown. In FIG. 3 the cross section of the load bearing member 3 as viewed in the longitudinal direction I of the load bearing member 3 is shown in particular. The rope could alternatively have some other number of load bearing members 3, either more or less than what is disclosed in the Figures.

The load bearing members 3-6 are made of composite material comprising reinforcing fibers F embedded in polymer matrix m. The reinforcing fibers F are more specifically distributed in polymer matrix m and bound together by the polymer matrix, particularly such that an elongated rod-like piece is formed. Thus, each load bearing member 3-6 is one solid elongated rod-like piece. The reinforcing fibers F are distributed preferably substantially evenly in the polymer matrix m. Thereby a load bearing member with homogeneous properties and structure is achieved throughout its cross section. In this way, it can be also ensured that each of the fibers can be in contact and bonded with the matrix m. Said reinforcing fibers F are most preferably carbon fibers as they are electrically conducting and have excellent properties in terms of load bearing capacity, weight and tensile stiffness, which makes them particularly well suitable for use in elevator hoisting ropes. Alternatively, said reinforcing fibers F can be of any other fiber material which is electrically conducting. The matrix m comprises preferably of epoxy, but alternative materials could be used depending on the preferred properties. Preferably, substantially all the reinforcing fibers F of each load bearing member 3-6 are parallel with the longitudinal direction of the load bearing member 3-6. Thereby the fibers are also parallel with the longitudinal direction of the hoisting rope 1 as each load bearing member is oriented parallel with the longitudinal direction of the hoisting rope 1. Thereby, the fibers in the final hoisting rope 1 will be aligned with the force when the hoisting rope 1 is pulled, which ensures that the structure provides high tensile stiffness. This is also advantageous for achieving unproblematic behavior of the internal structure, particularly internal movement, when the hoisting rope 1 is bent.

The fibers F used in the preferred embodiments are substantially untwisted in relation to each other, which provides them said orientation parallel with the longitudinal direction of the hoisting rope 1. This is in contrast to the conventionally twisted elevator ropes, where the wires or fibers are strongly twisted and have normally a twisting angle from 15 up to 30 degrees, the fiber/wire bundles of these conventionally twisted elevator ropes thereby having the potential for transforming towards a straighter configuration under tension, which provides these ropes a high elongation under tension as well as leads to an unintegral structure.

The reinforcing fibers F are preferably long continuous fibers in the longitudinal direction of the load bearing member, the fibers F preferably continuing for the whole length of the load bearing member 3-6 as well as the hoisting rope 1. Thus, the load bearing ability, good conductivity as well as manufacturing of the load bearing member 3-6 are facilitated. The fibers F being oriented parallel with longitudinal direction of the hoisting rope 1, as far as possible, the cross section of the load bearing member 3-6 can be made to continue substantially the same in terms of its cross-section for the whole length of the hoisting rope 1. Thus, no substantial relative movement can occur inside the load bearing member 3-6 when it is bent.

As mentioned, the reinforcing fibers F are preferably distributed in the aforementioned load bearing member 3-6 substantially evenly, in particular as evenly as possible, so that the load bearing member 3-6 would be as homogeneous as possible in the transverse direction thereof. An advantage of the structure presented is that the matrix m surrounding the reinforcing fibers F keeps the interpositioning of the reinforcing fibers F substantially unchanged. It equalizes with its slight elasticity the distribution of a force exerted on the fibers, reduces fiber-fiber contacts and internal wear of the hoisting rope, thus improving the service life of the hoisting rope 1. The composite matrix m, into which the individual fibers F are distributed as evenly as possible, is most preferably made of epoxy, which has good adhesion to the reinforcement fibers F and which is known to behave advantageously with carbon fiber. Alternatively, e.g. polyester or vinyl ester can be used, but alternatively any other suitable alternative materials can be used. FIG. 3 presents inside the circle a partial cross-section of the load bearing member 3-6 close to the surface thereof as viewed in the longitudinal direction of the hoisting rope 1. The reinforcing fibers F of the load bearing member 3-6 are preferably organized in the polymer matrix m according to this cross-section. The rest (parts not showed) of the load bearing member 3-6 have a similar structure.

Figure 4:
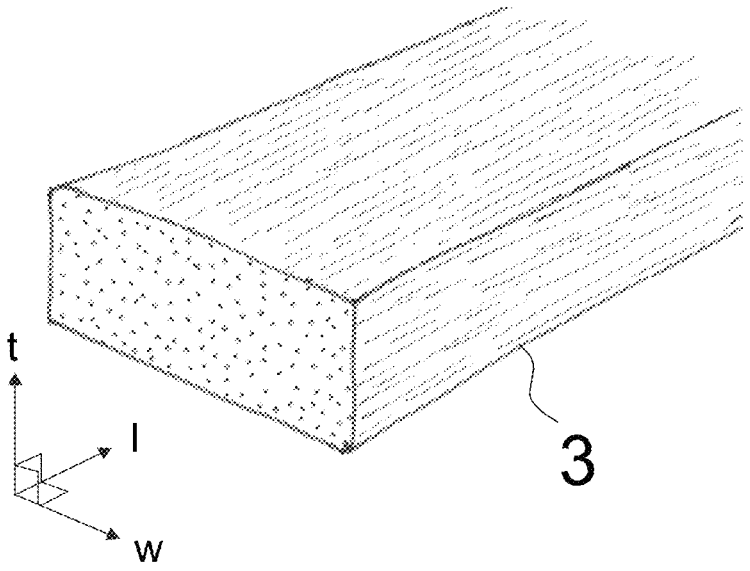
FIG. 4 illustrates a three dimensional view of a section of the load bearing member according to the present invention.

FIG. 4 illustrates a three dimensional view of a section of the load bearing member according to the present invention. From the presented FIG. 3 and FIG. 4 it can also be seen how the individual reinforcing fibers F of a load bearing member 3 are substantially evenly distributed in the polymer matrix m, which surrounds the reinforcing fibers F. The polymer matrix m fills the areas between individual reinforcing fibers F and binds substantially all the reinforcing fibers F that are inside the matrix m to each other as a uniform solid substance. A chemical bond exists between, the individual reinforcing fibers F (preferably each of them) and the matrix m, one advantage of which is uniformity of the structure. To improve the chemical adhesion of the reinforcing fiber to the matrix m, in particular to strengthen the chemical bond between the reinforcing fiber F and the matrix m, each fiber can have a thin coating, e.g. a primer (not presented) on the actual fiber structure between the reinforcing fiber structure and the polymer matrix m. However, this kind of thin coating is not necessary. The properties of the polymer matrix m can also be optimized as it is common in polymer technology. For example, the matrix m can comprise a base polymer material (e.g. epoxy) as well as additives, which fine-tune the properties of the base polymer such that the properties of the matrix are optimized. The polymer matrix m is preferably of a hard non-elastomer as in this case a risk of buckling can be reduced for instance. However, the polymer matrix need not be non-elastomer necessarily, e.g. if the downsides of this kind of material are deemed acceptable or irrelevant for the intended use. In that case, the polymer matrix m can be made of elastomer material such as polyurethane or rubber for instance. The reinforcing fibers F being in the polymer matrix means here that the individual reinforcing fibers F are bound to each other with a polymer matrix m, e.g. in the manufacturing phase by immersing them together in the fluid material of the polymer matrix which is thereafter solidified. In this case the gaps of individual reinforcing fibers bound to each other with the polymer matrix comprise the polymer of the matrix. In this way a great number of reinforcing fibers bound to each other in the longitudinal direction of the hoisting rope are distributed in the polymer matrix. As mentioned, the reinforcing fibers are preferably distributed substantially evenly in the polymer matrix m, whereby the load bearing member is as homogeneous as possible when viewed in the direction of the cross-section of the hoisting rope. In other words, the fiber density in the cross-section of the load bearing member 3-6 does not therefore vary substantially. The individual reinforcing fibers of the load bearing member 3-6 are mainly surrounded with polymer matrix m, but random fiber-fiber contacts can occur because controlling the position of the fibers in relation to each other in their simultaneous impregnation with polymer is difficult, and on the other hand, perfect elimination of random fiber-fiber contacts is not necessary from the viewpoint of the functioning of the solution. If, however, it is desired to reduce their random occurrence, the individual reinforcing fibers F can be precoated with material of the matrix m such that a coating of polymer material of said matrix is around each of them already before they are brought and bound together with the matrix material, e.g. before they are immersed in the fluid matrix material.

As above mentioned, the matrix m of the load bearing member 3-6 is most preferably hard in its material properties. A hard matrix m helps to support the reinforcing fibers F, especially when the hoisting rope bends, preventing buckling of the reinforcing fibers F of the bent rope, because the hard material supports the fibers F efficiently. To reduce the buckling and to facilitate a small bending radius of the load bearing member 3-6, among other things, it is therefore preferred that the polymer matrix m is hard, and in particular non-elastomeric. The most preferred materials for the matrix are epoxy resin, polyester, phenolic plastic or vinyl ester. The polymer matrix m is preferably so hard that its module of elasticity E is over 2 GPa, most preferably over 2.5 GPa. In this case the module of elasticity E is preferably in the range 2.5-10 GPa, most preferably in the range 2.5-3.5 GPa. There are commercially available various material alternatives for the matrix m which can provide these material properties.

Preferably over 50% of the surface area of the cross-section of the load bearing member 3-6 is of the aforementioned electrically conducting reinforcing fiber. Thereby, good conductivity can be ensured. Fibers F will be in contact with each other randomly along their length whereby electromagnetic wave signal inserted into the load bearing member will propagate within substantially the whole cross section of the load bearing member. To be more precise preferably 50%-80% of the surface area of the cross-section of the load bearing member 3-6 is of the aforementioned reinforcing fiber, most preferably such that 55%-70% is of the aforementioned reinforcing fiber, and substantially all the remaining surface area is of polymer matrix. In this way conductivity and longitudinal stiffness of the load bearing member 3-6 are facilitated yet there is enough matrix material to bind the fibers F effectively to each other. Most preferably, this is carried out such that approx. 60% of the surface area is of reinforcing fiber and approx. 40% is of matrix material.

Figure 5A:
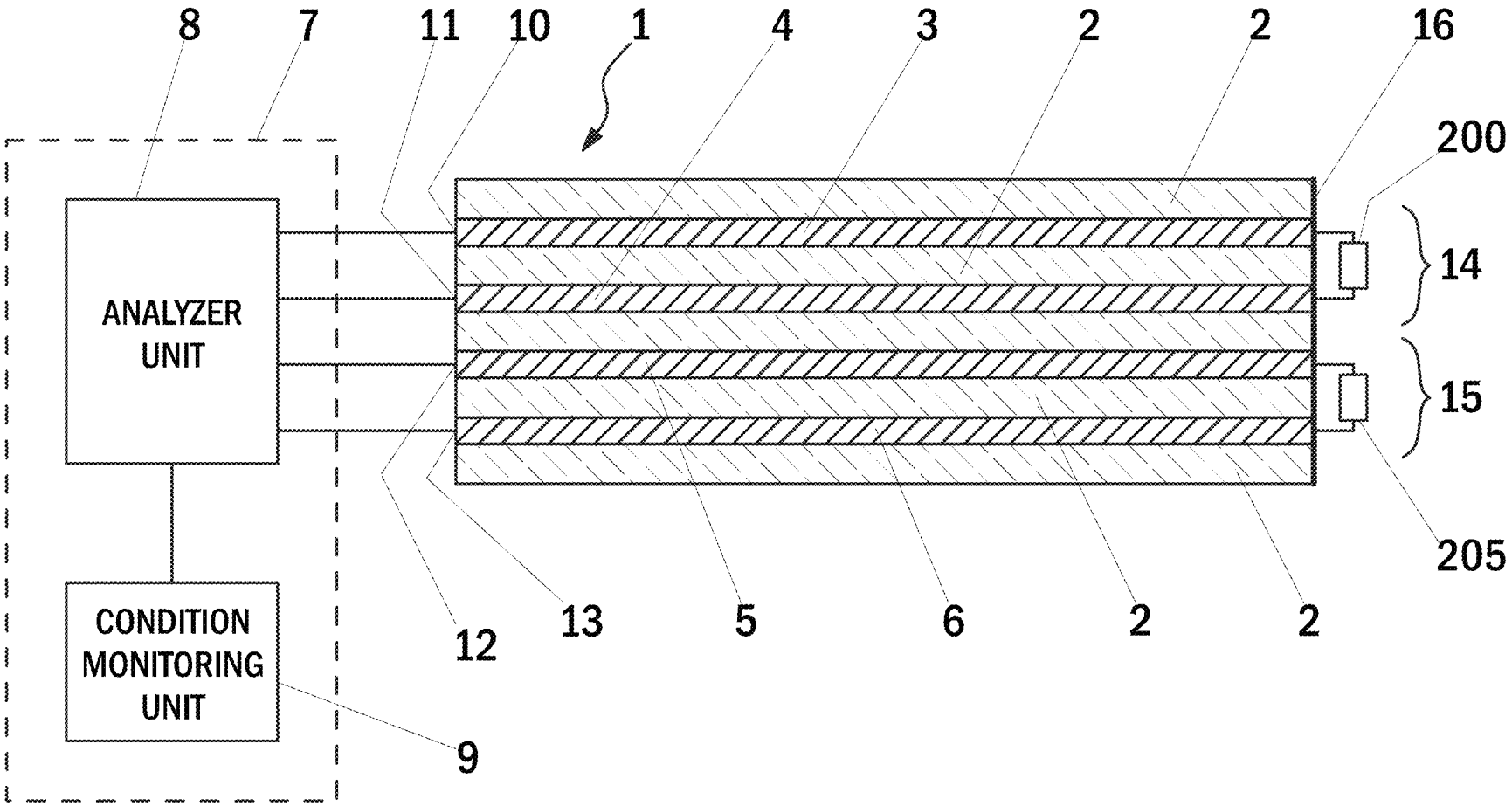
FIG. 5A illustrates another arrangement for condition monitoring of a hoisting rope of a hoisting apparatus according to one embodiment of the present invention.

FIG. 5A illustrates another arrangement for condition monitoring of a hoisting rope of a hoisting apparatus according to one embodiment of the present invention. The hoisting rope 1 is belt-shaped, i.e. larger in width direction than thickness direction and has a first end and other end 16. The hoisting rope 1 comprises a non-conductive coating 2, and a plurality of conductive load bearing members 3-6 for bearing the load exerted on the hoisting rope 1 in longitudinal direction thereof, which are adjacent in width direction of the hoisting rope 1. The load bearing members 3-6 are embedded in the non-conductive coating 2 and extend parallel to each other as well as to the longitudinal direction of the hoisting rope 1 unbroken throughout the length of the hoisting rope 1. The coating 2 forms the surface of the hoisting rope 1 and extends between adjacent load bearing members 3-6, thereby isolating them from each other both mechanically and electrically. The said conductive load bearing members 3-6 may be made of non-metal material. The said conductive load bearing members 3-6 may be made of composite material comprising electrically conducting reinforcing fibers (F) in polymer matrix (m), said reinforcing fibers (F) preferably being carbon fibers.

The presented another arrangement for condition monitoring of a hoisting rope of a hoisting apparatus according to the embodiment of the present invention also comprises a control system 7 for controlling the hoisting apparatus said control system 7 having an analyzer unit 8 and a condition monitoring unit 9. The analyzer unit 8 is capable of generating and inserting propagating electromagnetic wave signals to said conductive load bearing members 3-6 and capable of detecting and analyzing reflected electromagnetic wave signals from said conductive load bearing members 3-6. The condition monitoring unit 9 is capable of monitoring one or more parameters provided by the analyzer unit 8 so as to determine condition of the hoisting rope 1.

The analyzer unit 8 according to the presented arrangement has connections interfaces 10-13 coupled to the conductive load bearing members 3-6 of the hoisting rope 1. In the arrangement for condition monitoring of a hoisting rope of a hoisting apparatus according to the embodiment of the present invention there is created a first parallel conductor transmission line 14 using two individual conductive load bearing members 3, 4. Respectively, a second parallel conductor transmission line 15 is created using two individual conductive load bearing members 5, 6. Consequently, two transmission lines 14, 15 next to each other in the same hoisting rope 1 are created.

In the arrangement for condition monitoring of a hoisting rope of a hoisting apparatus according to the presented another embodiment of the present invention also comprises an at least one impedance matching element 200, 205 arranged at the other end 16 of the hoisting rope 1. Of said at least one impedance matching elements 200. 205 one element 200 is connected between the ends of the load bearing members 3 and 4 for matching the impedance of the first parallel conductor transmission line 14. Respectively of said at least one impedance matching elements 200. 205 one element 205 is connected between the ends of the load bearing members 5 and, 6, for matching the impedance of the second parallel conductor transmission line 15.

In the arrangement for condition monitoring of a hoisting rope of a hoisting apparatus according to the presented another embodiment of the present invention a propagating electromagnetic wave signal, e.g. an alternating voltage/current signal is generated and inserted by the analyzer unit 8 which said alternating voltage/current signals are inserted to said conductive load bearing members 3-6 for propagating in positive z-direction according well-established one-directional wave equations. As the electromagnetic wave signal, e.g. the alternating voltage/current signal propagating along the first parallel conductor transmission line 14 or along the second parallel conductor transmission line 15 reaches the other end 16 of the hoisting rope 1 and said at least one impedance matching element 200, 205 a portion of the said signal will reflect back as a reflected electromagnetic wave signal. The reflected electromagnetic wave signal reflecting from the other end 16 of the hoisting rope 1 propagates back along the first parallel conductor transmission line 14 or along the second parallel conductor transmission line 15 and is detected and analyzed by the analyzer unit 8.

The measured parameters can be scattering parameters which describe the fraction of reflected/transmitted wave in relation to the incident wave. If the input impedance is not matched with the characteristic impedance of the rope, a reflection and transmission will occur already at the interface between the input cable and rope. If the transmission line consisting of two conductors is shorted or left open at the end, a reflection coefficient will be −1 or +1 respectively, i.e. full reflection will occur with or without a reversal of phase. Also If the termination using said at least one impedance matching element 200, 205 is made to a load matching the characteristic impedance, there is no mismatch and no reflection will occur. After the analysis the analyzer unit 8 provides one or more parameters for monitoring by the condition monitoring unit 9. After the condition monitoring unit 9 has received one or more parameters for the determination of the types of the defects and condition of the hoisting rope 1, the condition monitoring unit 9 performs condition monitoring actions.

Figure 5B:
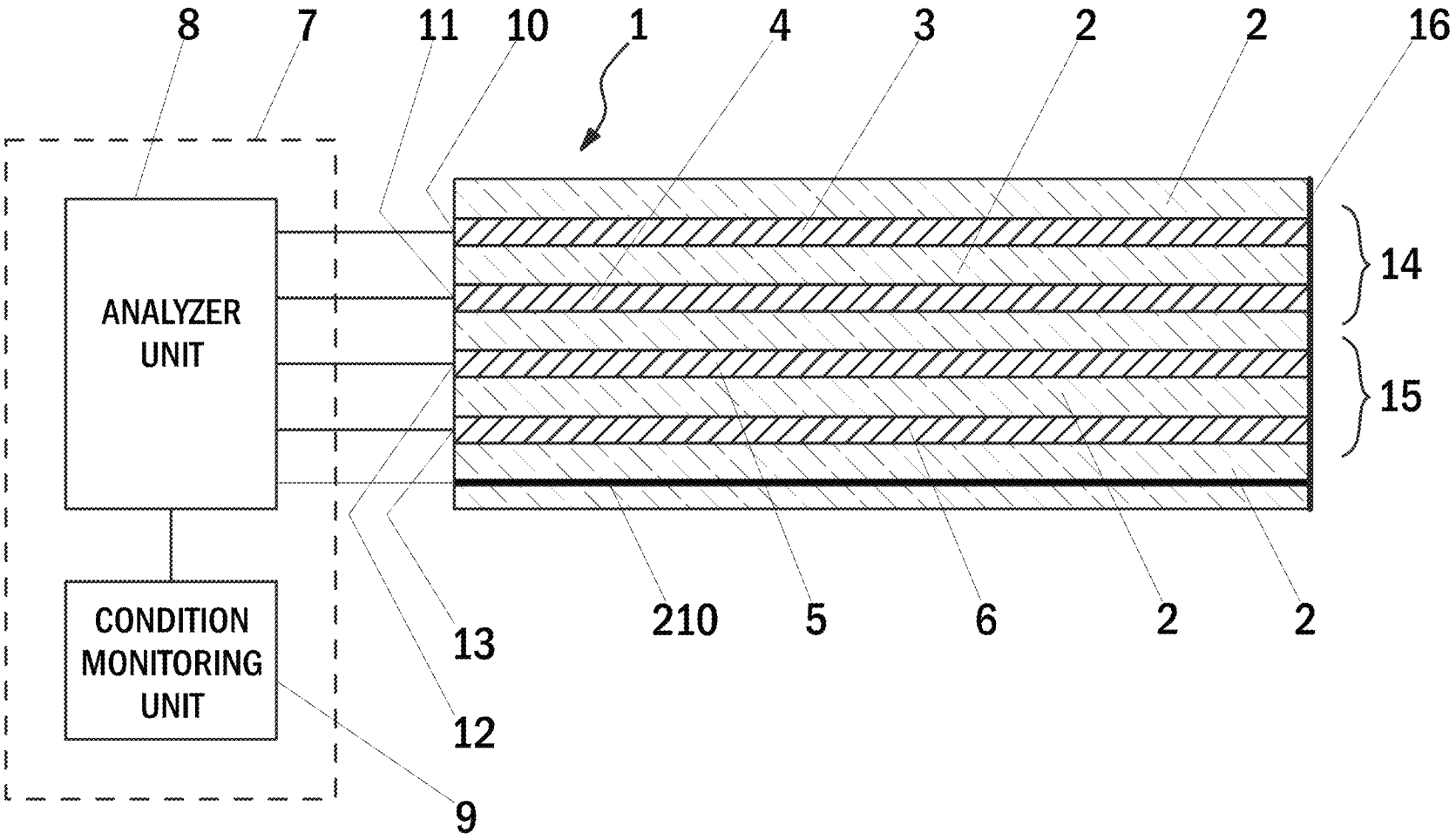
FIG. 5B illustrates a third arrangement for condition monitoring of a hoisting rope of a hoisting apparatus according to one embodiment of the present invention.

FIG. 5B illustrates a third arrangement for condition monitoring of a hoisting rope of a hoisting apparatus according to one embodiment of the present invention. The arrangement for condition monitoring of a hoisting rope of a hoisting apparatus presented in FIG. 5B is similar to that of presented in FIG. 1 with the exception of that is provided one additional conductor 210 extending unbroken throughout the length of the hoisting rope 1. The analyzer unit 8 according to the presented arrangement has an connection interface coupled to the additional conductor 210.

Figure 5C:
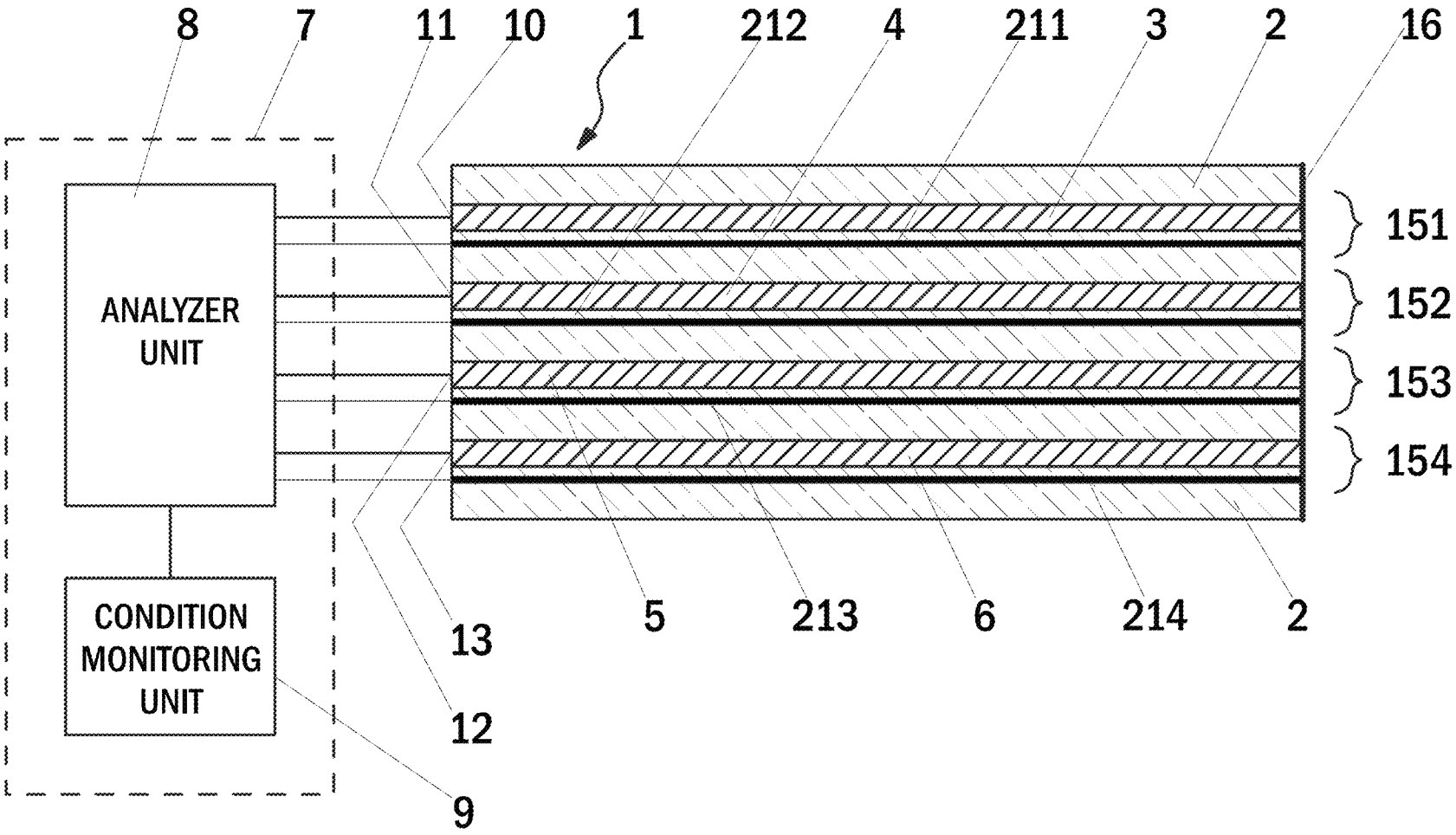
FIG. 5C illustrates a fourth arrangement for condition monitoring of a hoisting rope of a hoisting apparatus according to one embodiment of the present invention.

FIG. 5C illustrates a fourth arrangement for condition monitoring of a hoisting rope of a hoisting apparatus according to one embodiment of the present invention. In the arrangement for condition monitoring of a hoisting rope of a hoisting apparatus presented in FIG. 5C there is provided one additional conductor 211-214 running next to each of the said conductive load bearing members 3-6 and extending unbroken throughout the length of the hoisting rope 1. The analyzer unit 8 according to the presented arrangement has connections interfaces coupled to the additional conductors 211-214.

In the fourth arrangement for condition monitoring of a hoisting rope of a hoisting apparatus according to the embodiment of the present invention there is created parallel conductor transmission lines 151-154 of which each using one individual conductive load bearing member 3-6 and one additional conductor 211-214.

The additional conductors 210-214 presented in FIG. 5B-5C may be metallic or non-metallic conductors. The additional conductors 210-214 may be either embedded in the dielectric protective coating or outside it in free air separated using standoffs. The additional conductors 210-214 may be of the same material as the conductive load bearing member 3-6. The additional conductors 210-214 may be made of non-metal material. The additional conductors 210-214 may be made of composite material comprising electrically conducting reinforcing fibers (F) in polymer matrix (m), said reinforcing fibers (F) preferably being carbon fibers.

Figure 6:
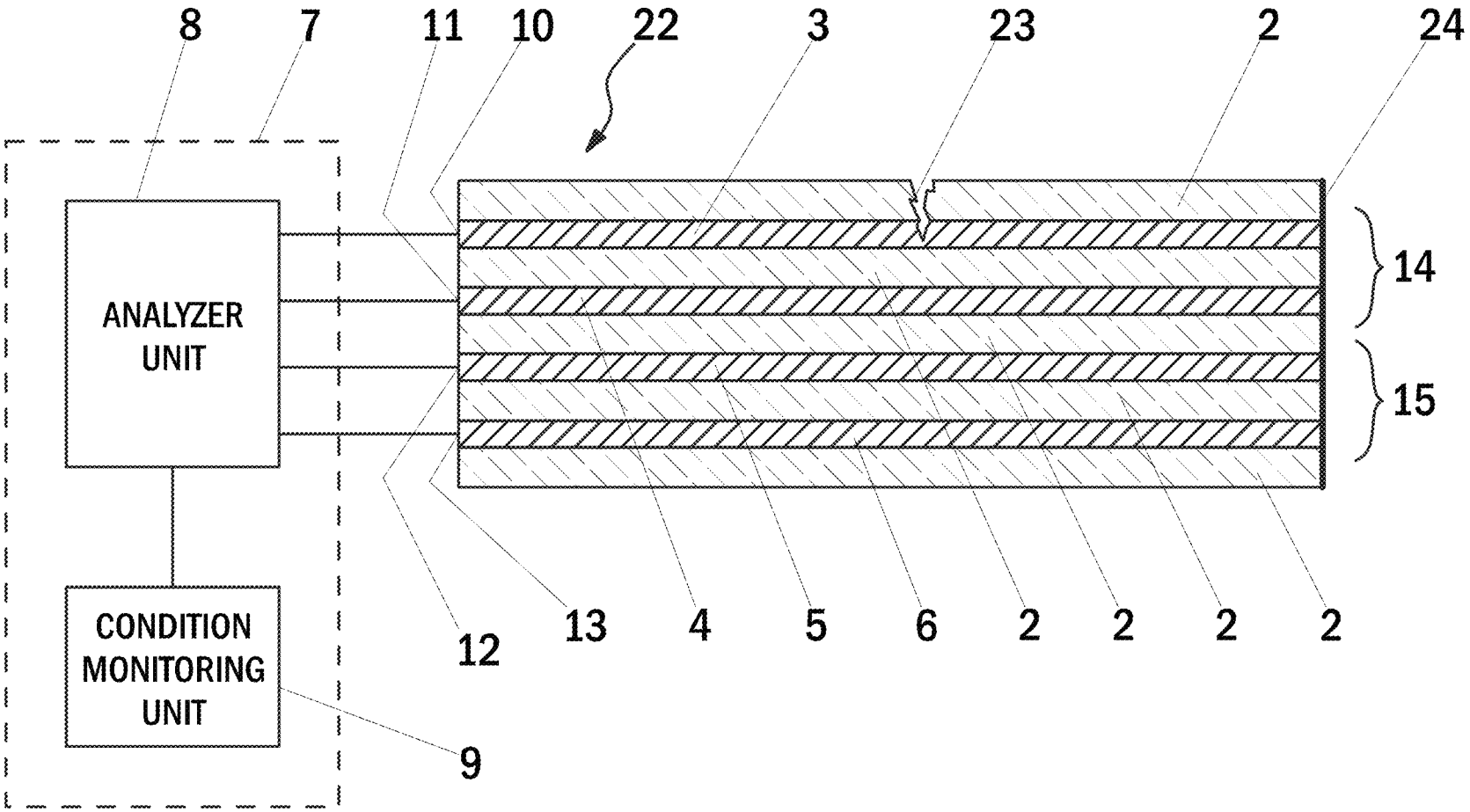
FIG. 6 illustrates an arrangement for condition monitoring of a hoisting rope of a hoisting apparatus according to a fifth embodiment of the present invention having a defect in the hoisting rope.

FIG. 6 illustrates an arrangement for condition monitoring of a hoisting rope of a hoisting apparatus according to a fifth embodiment of the present invention having a defect in the hoisting rope. The arrangement for condition monitoring of a hoisting rope of a hoisting apparatus presented in FIG. 6 is similar to that of presented in FIG. 1 with the exception of that there is a defect 23 in the first parallel conductor transmission line 14 of the defected hoisting rope 22 of FIG. 6. The defected hoisting rope 22 is partially broken from a defect 23 in the middle part of the defected hoisting rope 22.

In the arrangement for condition monitoring of a hoisting rope of a hoisting apparatus according to the presented fifth embodiment of the present invention having defect in the hoisting rope a propagating electromagnetic wave signal, e.g. an alternating voltage/current signal is generated and inserted by the analyzer unit 8 which said alternating voltage/current signals are inserted to said conductive load bearing members 3-6 for propagating in positive z-direction according well-established one-directional wave equations. As the electromagnetic wave signal, e.g. the alternating voltage/current signal propagating along the defected first parallel conductor transmission line 14 reaches the defect 23 in the middle part of the conductive load bearing member 3 of the first parallel conductor transmission line 14 a part of the said signal will reflect back as a first portion of the reflected electromagnetic wave signal and rest of the said signal will continue towards the end 24 of the defected hoisting rope 22.

After this the rest of the electromagnetic wave signal propagates from said defect 23 further along the defected first parallel conductor transmission line 14 and the end 24 of the defected hoisting rope 22. At the end 24 of the defected hoisting rope 22 of the rest of the electromagnetic wave signal will reflect back as a second portion of the reflected electromagnetic wave signal from the end 24 of the defected hoisting rope 22. The first and second portions of the reflected electromagnetic wave signal reflecting from the defected hoisting rope 22 propagate back along the first parallel conductor transmission line 14 and is detected as a reflected electromagnetic wave signal and analyzed by the analyzer unit 8. Furthermore, in the arrangement for condition monitoring of a hoisting rope of a hoisting apparatus according to the present invention, low-pass frequency sweep mode of the analyzer unit 8, e.g. of a network analyzer 8, may be used. This gives not only information of an impedance mismatch but also whether the discontinuity is capacitive or inductive thus giving indication of the damage type.

After the analysis the analyzer unit 8 provides one or more parameters for monitoring by the condition monitoring unit 9. After the condition monitoring unit 9 has received one or more parameters for the determination that the condition of the hoisting rope 22 has a fault and for the determination of the types of the defects and condition of the hoisting rope 1, 22 the condition monitoring unit 9 performs condition monitoring actions.

The arrangement for condition monitoring of a hoisting rope of a hoisting apparatus according to the present invention may be used monitoring a multiple different kinds of defects in the hoisting rope 1, 22 said multiple different kinds of defects including porosity, dry fibers, improper curing, fiber waviness/misalignment, matrix cracking, delamination, microbuckling, kinking, fiber-matrix debonding, fiber failure, fatigue evolution and damage evolution.

Any time there is a discontinuity in the electrical properties of the parallel conductor transmission line 14, 15, the currently propagating electromagnetic wave signal will split into a reflected electromagnetic wave and a further propagating electromagnetic wave. Consequently, the reflected electromagnetic wave signal detected and analyzed by the analyzer unit 8 may comprise several reflected electromagnetic wave signal portions reflected from different transmission line discontinuities.

Analyzing the reflected electromagnetic wave signal by the analyzer unit 8 gives information about damages affecting electro-magnetic properties, about the location of damage and also about the magnitude of impedance mismatch. With the help of the present invention the severity of the defect such as e.g. fiber damage can be quantified.

The analyzer unit 8 may be instructed to or may be automated to carry out multiple measurements. Even thousands of measurements can be carried out. While measuring, sources of electromagnetic noise (e.g. electric motor) can be shut down for the duration of the measurements without interfering with the operation of the elevator too much. In said multiple measurements the analyzer unit 8 may change the generated propagating electromagnetic wave signal by changing e.g. signal form, signal amplitude and/or signal frequency. Furthermore, the analyzer unit 8 may be instructed to analyze the multiple measurements in the frequency-domain for counter-act distortion and attenuation effects. Furthermore, the changing of the generated propagating electromagnetic wave signal the analyzer unit 8 may carry out changes for matching the impedance of the parallel conductor transmission lines 14, 15.

Figure 7:
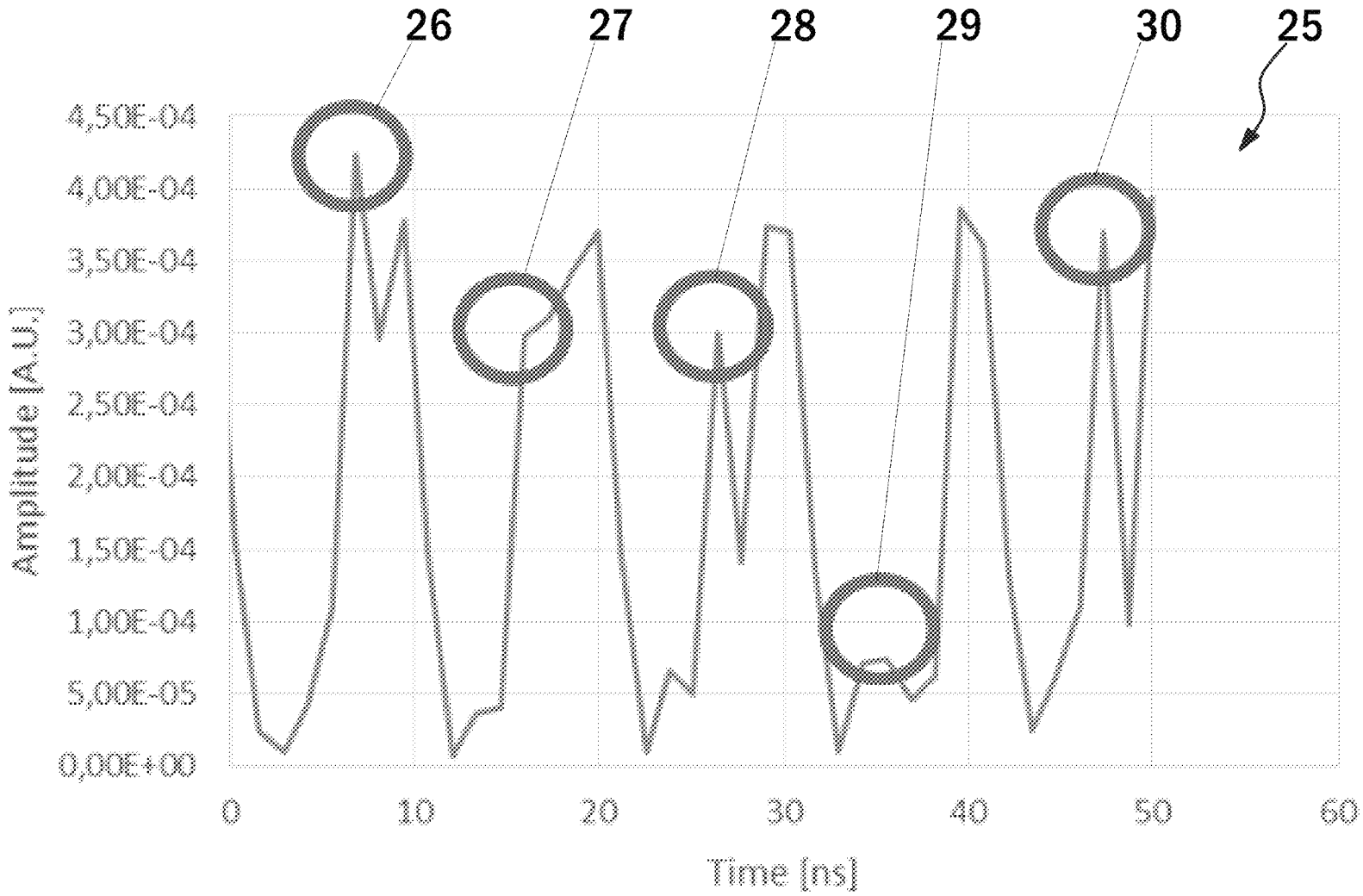
FIG. 7 illustrates another example of a reflected electromagnetic wave signal according to a fifth embodiment of the present invention having a defect in the hoisting rope.

FIG. 7 illustrates another example of a reflected electromagnetic wave signal according to a fifth embodiment of the present invention having a defect in the hoisting rope. The defected hoisting rope 22 according to the presented embodiment is partially broken from a first defect 23 in the middle part of the defected hoisting rope 22. In the example shown in FIG. 7 a first portion of the reflected electromagnetic wave signal is reflected back from the defect 23 in the middle part of the conductive load bearing member 3 of the first parallel conductor transmission line 14, a second portion of the reflected electromagnetic wave signal is reflected back from the end 24 of the defected hoisting rope 22. The first and second portions of the reflected electromagnetic wave signal reflecting from the defected hoisting rope 22 propagate back along the first parallel conductor transmission line 14 and is detected as a reflected electromagnetic wave signal and analyzed by the analyzer unit 8.

In the reflected electromagnetic wave signal 25 according to the presented fifth embodiment there can be detected unusual repeated peaks 26-30 indicating a defect 23 in the middle part of the defected hoisting rope 22. Furthermore, said defect 23 can be detected from the detected unusual repeated peaks 26-30 reflected back from the defect 23 in the middle part of the defected hoisting rope 22.

As from the detected reflected electromagnetic wave signal 25 the defect indicating peaks 26-30 can be detected and analyzed by the analyzer unit 8, the analyzer unit 8 provides one or more parameters to the condition monitoring unit 9 for the determination of the types of the defects and condition of the defected hoisting rope 22.

Figure 8:
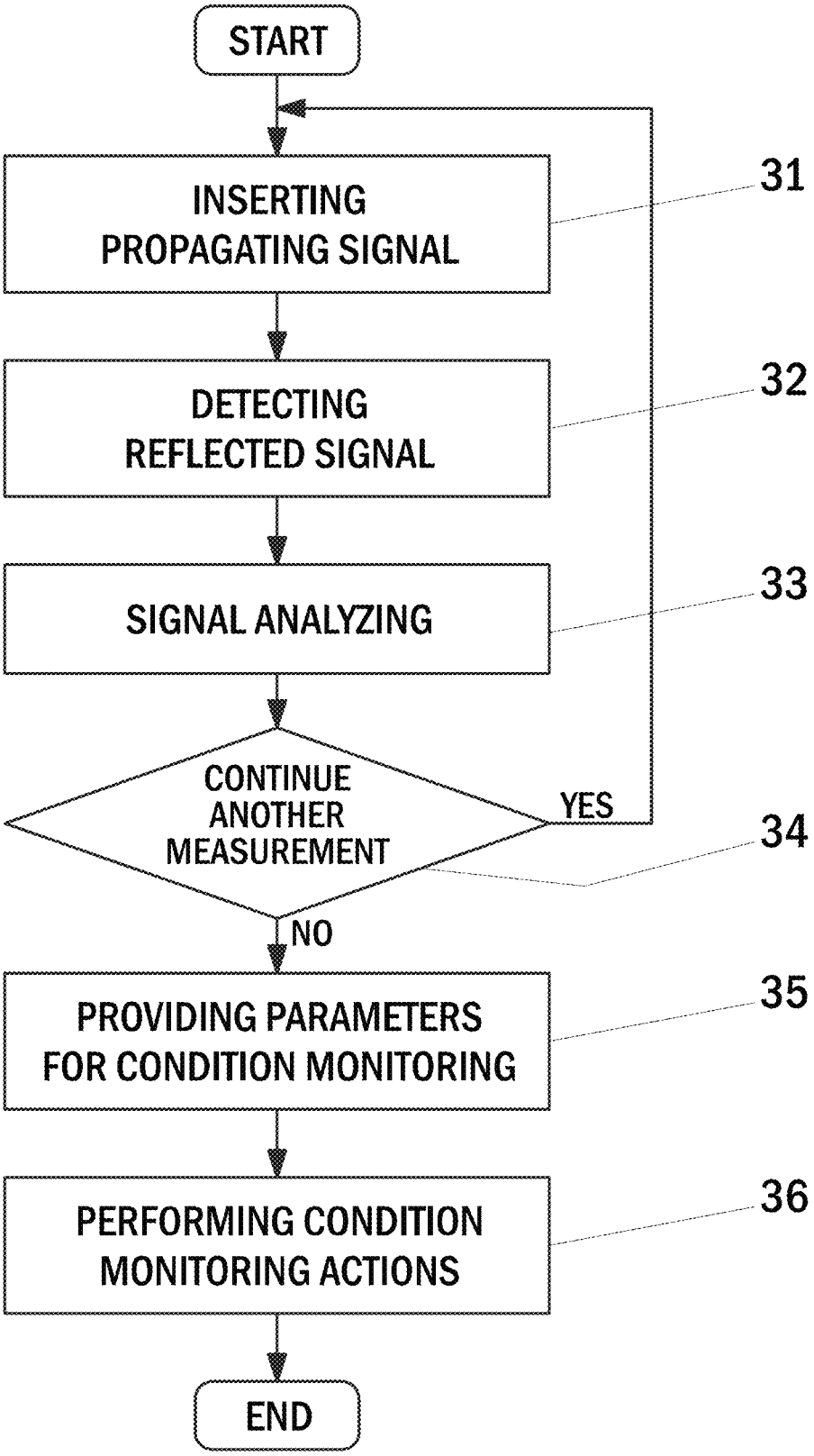
FIG. 8 illustrates a method for condition monitoring of a hoisting rope of a hoisting apparatus according to one embodiment of the present invention.

FIG. 8 illustrates a method for condition monitoring of a hoisting rope of a hoisting apparatus according to one embodiment of the present invention. In the method for condition monitoring according to one embodiment of the present invention an analyzer unit 8 first generates and transmits 31 a propagating electromagnetic wave signal to plurality of conductive load bearing members 3-6 for bearing the load exerted on the hoisting rope 1, 22 in longitudinal direction thereof, said conductive load bearing members 3-6 forming parallel conductor transmission lines 14, 15. Thereafter, the analyzer unit 8 detects 32 a reflected electromagnetic wave signal 17, 25 reflected back along said parallel conductor transmission lines 14, 15. After detecting, the said analyzer unit 8 analyzes 33 the detected reflected electromagnetic wave signals 17, 25.

After carrying out the steps of inserting 31, detecting 32 and analyzing 33 the analyzer unit 8 may or may not continue 34 with another measurement and repeat steps 31-33. The analyzer unit 8 may be instructed to or may be automated to carry out multiple measurements. In said multiple measurements the analyzer unit 8 may change the generated propagating electromagnetic wave signal by changing e.g. signal form, signal amplitude and/or signal frequency. Furthermore, the changing of the generated propagating electromagnetic wave signal the analyzer unit 8 may carry out changes for matching the impedance of the parallel conductor transmission lines 14, 15.

After carrying out enough measurements by repeating the steps 31-33 the analyzer unit 8 provides 35 one or more parameters to the condition monitoring unit 9 for the determination of the types of the defects and condition of the hoisting rope 1, 22. After receiving one or more parameters for the determination of the types of the defects and condition of the hoisting rope 1, 22 the condition monitoring unit 9 performs 36 condition monitoring actions.

Figure 9:
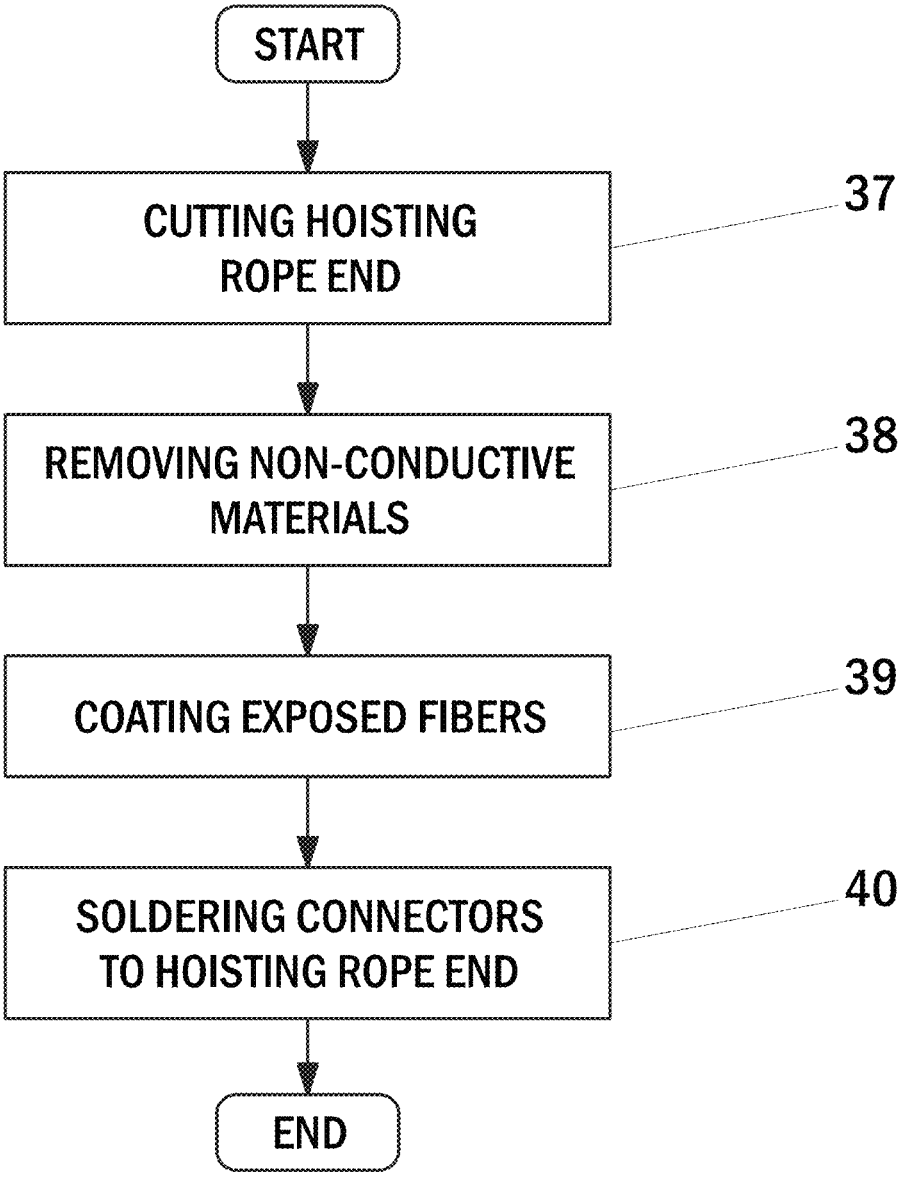
FIG. 9 illustrates one example of a method for improving an electrical contact arrangement between an analyzer unit and conductive load bearing members of an arrangement for condition monitoring of a hoisting rope of a hoisting apparatus according to one embodiment of the present invention.

FIG. 9 illustrates one example of a method for improving an electrical contact arrangement between an analyzer unit and conductive load bearing members of an arrangement for condition monitoring of a hoisting rope of a hoisting apparatus according to one embodiment of the present invention. In the method for improving an electrical contact arrangement between an analyzer unit and conductive load bearing members according to one embodiment of the present invention the end of the hoisting rope 1, 22 is first cut 37 without delaminating the hoisting rope 1, 22. The cutting 37 of the hoisting rope 1, 22 end may be done e.g. with a high-speed abrasive disc. In the cutting 37 process water or ethanol may be used as a coolant to prevent the clogging of the said high-speed abrasive disc and to prevent the heating of the polymer matrix of the hoisting rope 1, 22.

After the cutting 37 of the hoisting rope 1, 22 end non-conductive materials such as thermoplastic polyurethane or other thermoplastic elastomers and polymer matrix are removed 38 around the carbon fibers. The removing 38 may e.g. be carried out using repeated rapid heating cycles for example with oxy-acetylene or similar flame or with induction coils.

After the cutting 37 of the hoisting rope 1, 22 end and removing 38 non-conductive materials around the carbon fibers the exposed fibers are coated 39 with metal such as e.g. copper or nickel for example using electrodeposition.

In one example of a process for coating 39 said exposed fibers the electrolyte may consist of an aqueous solution of copper sulfate (200 g/Liter $CuSO_4.5H_2O$) and sulfuric acid (50 g/Liter $H_2SO_4$). In said coating process high-purity copper anode may be used and a conductive load bearing member of a hoisting rope may be used as a cathode to feed the current fed through from the other end. Aluminum foil can be used to improve the electrical connection of the cathode. A current density of 2-20 $A/dm^2$, an electrode potential difference of 0.2-6 V and a deposition time of one hour may be used.

After the cutting 37 of the hoisting rope 1, 22 end, removing 38 non-conductive materials around the carbon fibers and coating 39 the exposed fibers the connections interfaces 10-13 of the an analyzer unit 8 are soldered 40 directly to the coated exposed fibers of the hoisting rope 1, 22 end.

Figure 10:
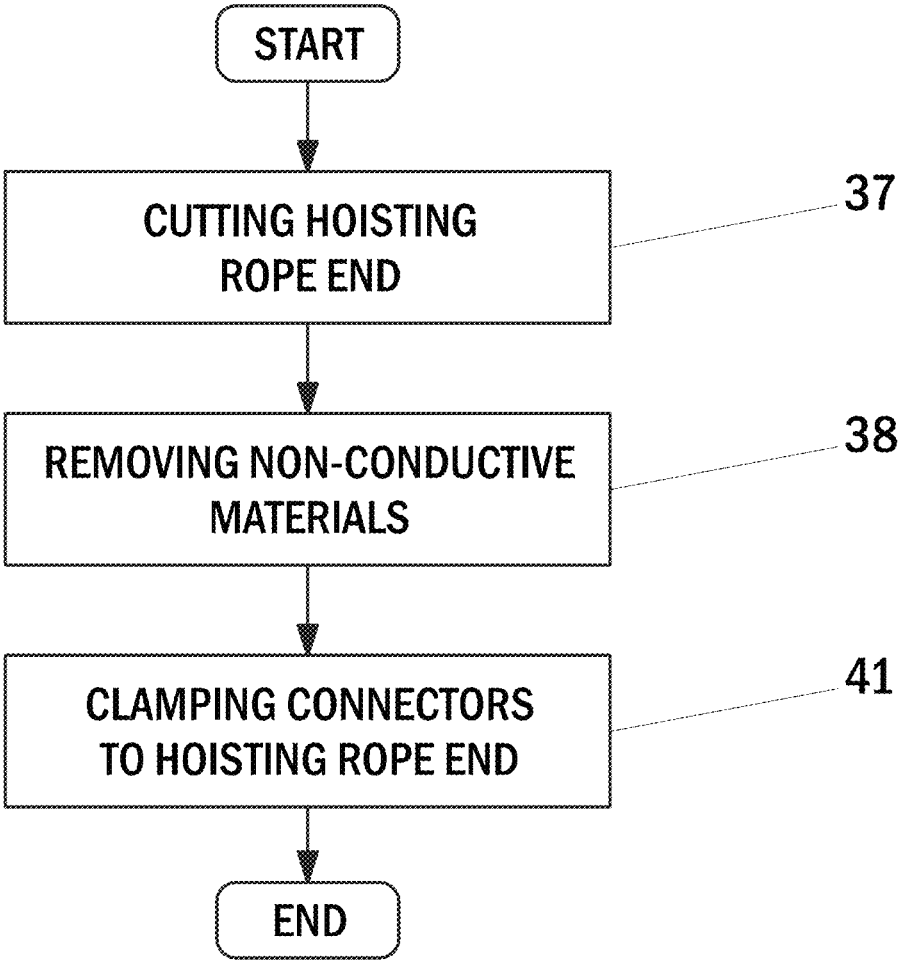
FIG. 10 illustrates another example of a method for improving an electrical contact arrangement between an analyzer unit and conductive load bearing members of an arrangement for condition monitoring of a hoisting rope of a hoisting apparatus according to one embodiment of the present invention.

FIG. 10 illustrates another example of a method for improving an electrical contact arrangement between an analyzer unit and conductive load bearing members of an arrangement for condition monitoring of a hoisting rope of a hoisting apparatus according to one embodiment of the present invention. In the method for improving an electrical contact arrangement between an analyzer unit and conductive load bearing members according to one embodiment of the present invention the end of the hoisting rope 1, 22 is first cut 37 without delaminating the hoisting rope 1, 22. The cutting 37 of the hoisting rope 1, 22 end may be done e.g. with a high-speed abrasive disc. In the cutting 37 process water or ethanol may be used as a coolant to prevent the clogging of the said high-speed abrasive disc and to prevent the heating of the polymer matrix of the hoisting rope 1, 22.

After the cutting 37 of the hoisting rope 1, 22 end non-conductive materials such as such as thermoplastic polyurethane or other thermoplastic elastomers and polymer matrix are removed 38 around the carbon fibers. The removing 38 may e.g. be carried out using repeated rapid heating cycles for example with oxy-acetylene or similar flame or with induction coils.

After the cutting 37 of the hoisting rope 1, 22 end and removing 38 non-conductive materials around the carbon fibers the connections interfaces 10-13 of the an analyzer unit 8 are clamped 41 directly e.g. by using threaded screws to the exposed fibers of the hoisting rope 1, 22 end. In the said connection interfaces 10-13 soft copper or aluminum foil may be used to improve the connection.

Figure 11:
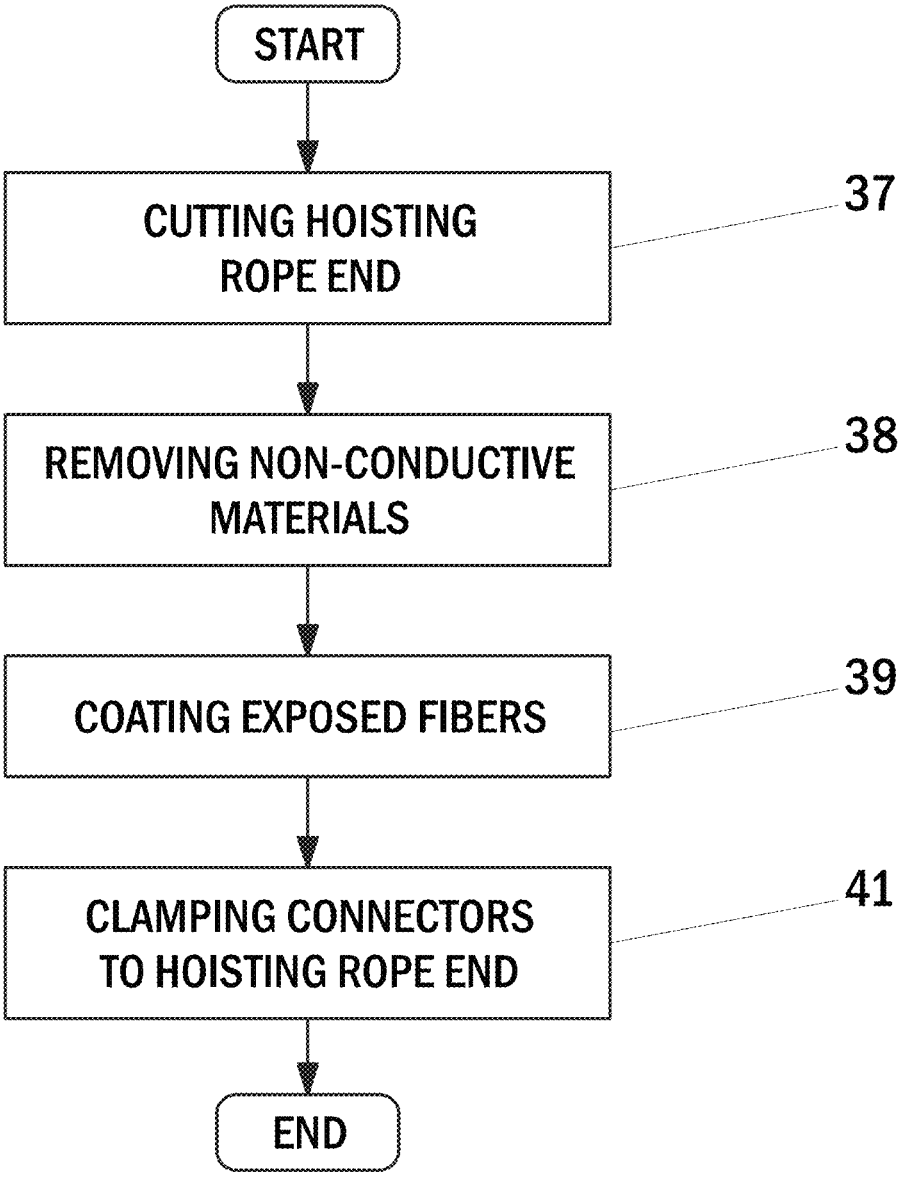
FIG. 11 illustrates a third example of a method for improving an electrical contact arrangement between an analyzer unit and conductive load bearing members of an arrangement for condition monitoring of a hoisting rope of a hoisting apparatus according to one embodiment of the present invention. The foregoing aspects, features and advantages of the invention will be apparent from the drawings and the detailed description related thereto.

FIG. 11 illustrates a third example of a method for improving an electrical contact arrangement between an analyzer unit and conductive load bearing members of an arrangement for condition monitoring of a hoisting rope of a hoisting apparatus according to one embodiment of the present invention. In the method for improving an electrical contact arrangement between an analyzer unit and conductive load bearing members according to one embodiment of the present invention the end of the hoisting rope 1, 22 is first cut 37 without delaminating the hoisting rope 1, 22. The cutting 37 of the hoisting rope 1, 22 end may be done e.g. with a high-speed abrasive disc. In the cutting 37 process water or ethanol may be used as a coolant to prevent the clogging of the said high-speed abrasive disc and to prevent the heating of the polymer matrix of the hoisting rope 1, 22.

After the cutting 37 of the hoisting rope 1, 22 end non-conductive materials such as thermoplastic polyurethane or other thermoplastic elastomers and polymer matrix are removed 38 around the carbon fibers. The removing 38 may e.g. be carried out using repeated rapid heating cycles for example with oxy-acetylene or similar flame or with induction coils.

After the cutting 37 of the hoisting rope 1, 22 end and removing 38 non-conductive materials around the carbon fibers the exposed fibers are coated 39 with metal such as e.g. copper or nickel for example using electrodeposition.

After the cutting 37 of the hoisting rope 1, 22 end, removing 38 non-conductive materials around the carbon fibers and coating 39 the exposed fibers the connections interfaces 10-13 of the an analyzer unit 8 are clamped 41 directly e.g. by using threaded screws to the coated exposed fibers of the hoisting rope 1, 22 end. In the said connection interfaces 10-13 soft copper or aluminum foil may be used to improve the connection.

the illustrated embodiments, the load bearing members 3-6 are substantially rectangular. However, this is not necessary as alternative shapes could be used. Said composite members 3-6 can be manufactured for example in any known way, such as in the manner presented in WO2009090299A1.

In the illustrated embodiments, the rope 1 comprises four load bearing members 3-6. Of course, alternative configurations are possible, where the arrangement is implemented with a rope provided with some other number of load bearing members 3-6.

When referring to conductivity, in this application it is meant electrical conductivity.

It is to be understood that the above description and the accompanying Figures are only intended to teach the best way known to the inventors to make and use the invention. It will be apparent to a person skilled in the art that the inventive concept can be implemented in various ways. The above-described embodiments of the invention may thus be modified or varied, without departing from the invention, as appreciated by those skilled in the art in light of the above teachings. It is therefore to be understood that the invention and its embodiments are not limited to the examples described above but may vary within the scope of the claims and their equivalents.

The invention claimed is:

1. An arrangement for condition monitoring of a hoisting rope of a hoisting apparatus, the hoisting rope comprising a non-conductive coating, and a plurality of adjacent conductive load bearing members for bearing the load exerted on the hoisting rope in a longitudinal direction thereof embedded in the coating, the coating forming the surface of the hoisting rope and extending between adjacent load bearing members thereby isolating the adjacent load bearing members from each other, said arrangement comprising:

a control system, said control system comprising an analyzer unit for generating and inserting propagating electromagnetic wave signals to an at least one parallel conductor transmission line formed by said conductive load bearing members and for detecting and analyzing reflected electromagnetic wave signals from said at least one parallel conductor transmission line formed by said conductive load bearing members, wherein said conductive load bearing members are made of composite material comprising electrically conducting reinforcing fibers in polymer matrix, wherein, upon detecting of a reflected electromagnetic wave signal having defect indicating peaks, the analyzer unit provides one or more parameters for the determination that the condition of the hoisting rope has a fault and for the determination of the types of the defects and condition of the hoisting rope, and wherein the electromagnetic wave signals generated by the analyzer unit include alternating voltage/current signals.

2. An arrangement for condition monitoring of a hoisting rope of a hoisting apparatus, the hoisting rope comprising a non-conductive coating, and a plurality of adjacent conductive load bearing members for bearing the load exerted on the hoisting rope in a longitudinal direction thereof embedded in the coating and extending parallel to each other and to the longitudinal direction of the hoisting rope, the coating forming the surface of the hoisting rope and extending between adjacent load bearing members thereby isolating the adjacent load bearing members from each other, said arrangement comprising:

a control system, said control system comprising an analyzer unit for generating and inserting propagating electromagnetic wave signals to an at least one parallel conductor transmission line formed by said conductive load bearing members and for detecting and analyzing reflected electromagnetic wave signals from said at least one parallel conductor transmission line formed by said conductive load bearing members, wherein said conductive load bearing members are made of composite material comprising electrically conducting reinforcing fibers in polymer matrix, wherein, upon detecting of a reflected electromagnetic wave signal having defect indicating peaks, the analyzer unit provides one or more parameters for the determination that the condition of the hoisting rope has a fault and for the determination of the types of the defects and condition of the hoisting rope, and wherein said conductive load bearing members are made of non-metal material.

3. The condition monitoring arrangement according to claim 1, wherein said analyzer unit provides one or more parameters for determining the condition of the hoisting rope.

4. The condition monitoring arrangement according to claim 1, wherein said analyzer unit is a signal generator/analyzer unit, a network analyzer unit, a scalar network analyzer unit or a vector network analyzer unit.

5. The condition monitoring arrangement according to claim 3, wherein said control system comprises a condition monitoring unit for monitoring one or more parameters provided by the analyzer unit so as to determine the condition of the hoisting rope.

6. The condition monitoring arrangement according to claim 1, wherein said arrangement comprises connections interfaces for coupling the analyzer unit to the conductive load bearing members at a first end of the hoisting rope.

7. The condition monitoring arrangement according to claim 1, wherein said arrangement comprises one or more additional conductors extending unbroken throughout the length of the hoisting rope.

8. The condition monitoring arrangement according to claim 7, wherein said one or more additional conductors are of the same material as the conductive load bearing members.

9. The condition monitoring arrangement according to claim 6, wherein said arrangement comprises additional connections interfaces for coupling the analyzer unit to the conductive load bearing members at a second end of the hoisting rope.

10. The condition monitoring arrangement according to claim 1, wherein said arrangement comprises an at least one impedance matching element, arranged at an end of the hoisting rope connected between ends of said load bearing members for matching the impedance of said at least one parallel conductor transmission line.

11. An arrangement for condition monitoring of a hoisting rope of a hoisting apparatus, the hoisting rope comprising a non-conductive coating, and a plurality of adjacent conductive load bearing members for bearing the load exerted on the hoisting rope in a longitudinal direction thereof embedded in the coating and extending parallel to each other and to the longitudinal direction of the hoisting rope, the coating forming the surface of the hoisting rope and extending between adjacent load bearing members thereby isolating the adjacent load bearing members from each other, said arrangement comprising:

a control system, said control system comprising an analyzer unit for generating and inserting propagating electromagnetic wave signals to an at least one parallel conductor transmission line formed by said conductive load bearing members and for detecting and analyzing reflected electromagnetic wave signals from said at least one parallel conductor transmission line formed by said conductive load bearing members, wherein said conductive load bearing members are made of composite material comprising electrically conducting reinforcing fibers in polymer matrix, wherein, upon detecting of a reflected electromagnetic wave signal having defect indicating peaks, the analyzer unit provides one or more parameters for the determination that the condition of the hoisting rope has a fault and for the determination of the types of the defects and condition of the hoisting rope, and wherein, upon detecting of a reflected electromagnetic wave signal having a stable amplitude except for the repeated peaks, the analyzer unit provides one or more parameters for the determination that the condition of the hoisting rope is faultless.

12. The condition monitoring arrangement according to claim 1, wherein the said analyzer unit provides information about the location of damage and/or about the magnitude of impedance mismatch.

13. The condition monitoring arrangement according to claim 12, wherein said analyzer unit provides information for quantifying the severity of the defect.

14. The condition monitoring arrangement according to claim 1, wherein said hoisting rope is larger in a width direction than a thickness direction.

15. The condition monitoring arrangement according to claim 1, wherein, upon receiving said one or more parameters for the determination of the condition of the hoisting rope, said monitoring unit performs condition monitoring actions.

16. The condition monitoring arrangement according to claim 1, wherein said analyzer unit carries out multiple measurements by changing signal form, signal amplitude and/or signal frequency.

17. The condition monitoring arrangement according to claim 16, wherein said analyzer unit carries out measurements for counter-acting distortion and attenuation effects.

18. The condition monitoring arrangement according to claim 16, wherein said analyzer unit carries out measurements for matching the impedance of the parallel conductor transmission lines.

19. A method for condition monitoring of a hoisting rope of a hoisting apparatus according to the condition monitoring arrangement of claim 1, said method comprising:

generating and inserting a propagating electromagnetic wave signal to an at least one parallel conductor transmission line formed by said conductive load bearing members;

detecting a reflected electromagnetic wave signal from said an at least one parallel conductor transmission line formed by said conductive load bearing members;

analyzing said detected electromagnetic wave signal; and upon detecting of a reflected electromagnetic wave signal having defect indicating peaks, providing one or more parameters for the determination that the condition of the hoisting rope has a fault and for the determination of the types of the defects and condition of the hoisting rope.

20. The condition monitoring arrangement according to claim 2, wherein said analyzer unit provides one or more parameters for determining the condition of the hoisting rope.

* * * * *